US011482100B2

(12) United States Patent
Tatourian et al.

(10) Patent No.: US 11,482,100 B2
(45) Date of Patent: Oct. 25, 2022

(54) TECHNOLOGIES FOR DETECTION OF ANOMALIES IN VEHICLE TRAFFIC PATTERNS

(71) Applicant: Intel Corporation, Santa Clara, CA (US)

(72) Inventors: Igor Tatourian, Santa Clara, CA (US); Rita H. Wouhaybi, Portland, OR (US); Simon Hunt, Santa Clara, CA (US); Hong Li, El Dorado Hills, CA (US)

( * ) Notice: Subject to any disclaimer, the term of this patent is extended or adjusted under 35 U.S.C. 154(b) by 0 days.

(21) Appl. No.: 14/672,102

(22) Filed: Mar. 28, 2015

(65) Prior Publication Data

US 2016/0284212 A1 Sep. 29, 2016

(51) Int. Cl.
*G08G 1/01* (2006.01)
*G08G 1/017* (2006.01)
(Continued)

(52) U.S. Cl.
CPC ..... *G08G 1/0129* (2013.01); *G08G 1/017* (2013.01); *G08G 1/0112* (2013.01);
(Continued)

(58) Field of Classification Search
CPC .. G08G 1/0104; G08G 1/0108; G08G 1/0112; G08G 1/0116; G08G 1/0125;
(Continued)

(56) References Cited

U.S. PATENT DOCUMENTS 9,081,650 B1 * 7/2015 Brinkmann ..... G07C 5/0808
9,104,535 B1 * 8/2015 Brinkmann ..... B60W 40/09
(Continued)

FOREIGN PATENT DOCUMENTS

CN 101540103 A 9/2009
CN 101783075 A 7/2010
CN 102368355 A 3/2012

OTHER PUBLICATIONS

First Office Action for Chinese Patent Application No. 201610172170.7 dated Feb. 1, 2018, 5 pages.
(Continued)

*Primary Examiner* — Peter D Nolan
*Assistant Examiner* — Michael F Whalen
(74) *Attorney, Agent, or Firm* — Hanley, Flight & Zimmerman

(57) ABSTRACT

Technologies for monitoring vehicle traffic include a traffic analysis server that receives infrastructure data from infrastructure sensors positioned along a road segment of a road and vehicle data from one or more vehicles travelling along the road segment. The traffic analysis server determines whether anomalies are present in the traffic data through the road segment based on an expected traffic behavior for the road segment. The traffic analysis server determines the expected traffic behavior for the road segment in a particular time window based on a historical traffic pattern associated with the road segment, based on historical vehicle data and historical infrastructure data captured during a prior time window corresponding to the particular time window for that road segment. Other embodiments are described and claimed.

17 Claims, 7 Drawing Sheets

(51) Int. Cl.
*G08G 1/0967* (2006.01)
*G08G 1/00* (2006.01)

(52) U.S. Cl.
CPC ..... *G08G 1/0116* (2013.01); *G08G 1/0133* (2013.01); *G08G 1/0145* (2013.01); *G08G 1/096725* (2013.01); *G08G 1/096741* (2013.01); *G08G 1/096775* (2013.01); *G08G 1/205* (2013.01)

(58) Field of Classification Search
CPC .. G08G 1/0129; G08G 1/0133; G08G 1/0137; H04W 4/30; H04W 4/40; H04W 4/44; H04W 4/46
See application file for complete search history.

(56) References Cited

U.S. PATENT DOCUMENTS 9,347,779 B1* 5/2016 Lynch ..... G01C 21/26
9,545,995 B1* 1/2017 Chau ..... B64C 13/06
2002/0111725 A1 8/2002 Burge
2003/0095046 A1* 5/2003 Borugian ..... B60R 25/33 340/576
2004/0210353 A1 10/2004 Rice
2009/0179777 A1* 7/2009 Ishikawa ..... G01M 15/042 340/939
2012/0162431 A1* 6/2012 Riesebosch ..... G08G 1/04 348/149
2013/0279392 A1* 10/2013 Rubin ..... H04L 67/12 370/312
2013/0279491 A1* 10/2013 Rubin ..... H04W 76/50 370/347
2013/0321136 A1* 12/2013 Park ..... G08C 17/02 340/12.54
2014/0176347 A1* 6/2014 Kim ..... G08G 1/096716 340/907
2014/0279573 A1* 9/2014 Coats ..... G06Q 30/0278 705/306
2015/0024705 A1* 1/2015 Rashidi ..... H04W 4/90 455/404.2
2015/0199895 A1* 7/2015 Hilliges ..... G08B 25/016 340/425.5
2016/0026182 A1* 1/2016 Boroditsky ..... H04L 67/306 701/23
2016/0037849 A1* 2/2016 Shearman ..... A42B 3/0426 2/424
2016/0140842 A1* 5/2016 Park ..... G08G 1/0112 340/905
2017/0069201 A1* 3/2017 Sedlik ..... G08G 1/0112
2017/0076227 A1* 3/2017 Elgie ..... G06N 99/005
2017/0164158 A1* 6/2017 Watkins ..... H04W 4/90
2017/0166219 A1* 6/2017 Jammoussi ..... B60W 50/045
2017/0278391 A1* 9/2017 Ono ..... B60W 10/04
2017/0309171 A1* 10/2017 Zhao ..... G01S 19/13
2017/0339401 A1* 11/2017 Mishima ..... H04N 17/002
2018/0005527 A1* 1/2018 Bostick ..... G08G 1/096725
2018/0037214 A1* 2/2018 Otake ..... B60W 10/18
2018/0039269 A1* 2/2018 Lambermont ..... G01S 13/865
2018/0293883 A1* 10/2018 Khokhlov ..... G08G 1/0141

OTHER PUBLICATIONS

The State Intellectual Property Office of People's Republic of China: "The Second Office Action," issued in corresponding Chinese Patent Application No. 201610172170.7 dated Oct. 9, 2018, 8 pages including partial English translation.
China National Intellectual Property Administration: "Notice on Grant of Patent Right for Invention," issued in corresponding Chinese Patent Application No. 201610172170.7, 4 pages including partial English translation.

* cited by examiner

TECHNOLOGIES FOR DETECTION OF ANOMALIES IN VEHICLE TRAFFIC PATTERNS

BACKGROUND

Typically, to operate, a vehicle relies on various sensors connected to components of the vehicle and a number of control units (e.g., an engine control unit (ECU), a transmission control unit (TCU), etc.) that rely on data from the sensors to respond to inputs from a driver of the vehicle. For example, when the driver depresses a gas pedal to accelerate the vehicle, an intake throttle valve coupled to the vehicle's engine opens to let more air into the engine. In response, a sensor coupled to the intake throttle valve provides a signal to the ECU, which may prompt the ECU to increase the fuel rate, for example. During the acceleration, additional sensors may monitor other variables, such as a mass air flow to the engine, an oxygen level in the exhaust, a rotation rate of a drive shaft driven by the engine, a wheel rotation monitor, etc., which may impact how the ECU responds.

Modern vehicles additionally include other sensors (e.g., presence sensors, cameras, global position locators, etc.) that can be used by user interfacing in-vehicle systems (e.g., back-up camera display systems, in-vehicle infotainment systems, navigation systems, parking assist systems, blind-spot monitoring systems, lane departure warning systems, etc.) to assist drivers of the vehicles during operation. For example, some vehicles are equipped with parking assist cameras and sensors to provide guidance to the driver while navigating into and out of parking spots. Further, some vehicles additionally include integrated software that analyzes feedback from the parking assist cameras and sensors to park the vehicle without assistance from the driver. In such vehicles, the integrated software provides inputs (e.g., acceleration, deceleration, wheel angle, etc.) to the ECU to successfully navigate the vehicle into and out of the parking spots. As such, the operation of the vehicle is dependent on the integrity of the integrated software.

BRIEF DESCRIPTION OF THE DRAWINGS

The concepts described herein are illustrated by way of example and not by way of limitation in the accompanying figures. For simplicity and clarity of illustration, elements illustrated in the figures are not necessarily drawn to scale. Where considered appropriate, reference labels have been repeated among the figures to indicate corresponding or analogous elements.

DETAILED DESCRIPTION OF THE DRAWINGS

Figure 1:
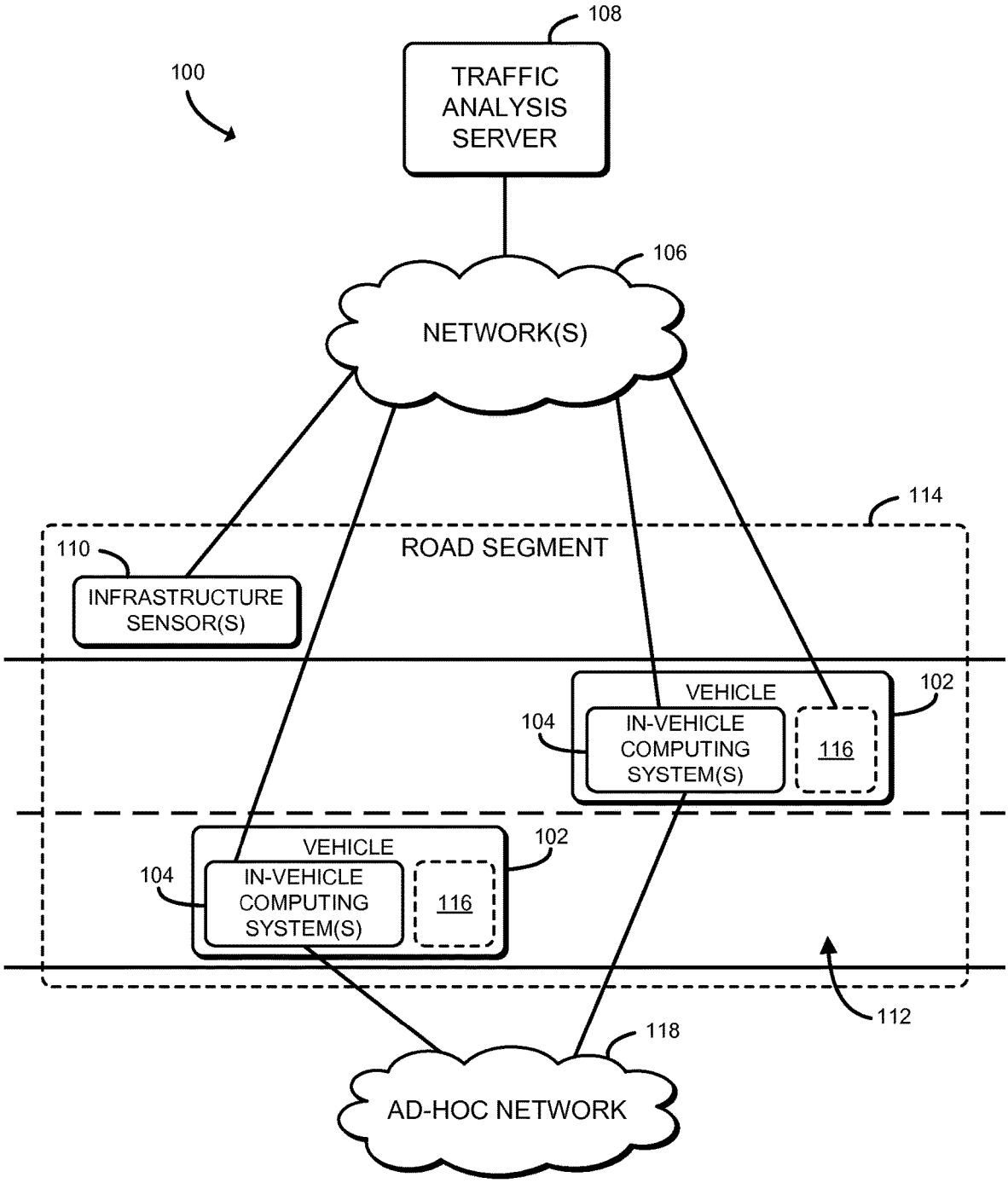
FIG. 1 is a simplified block diagram of at least one embodiment of a system for monitoring and analyzing vehicle traffic data.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. Additionally, it should be appreciated that items included in a list in the form of "at least one of A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

The disclosed embodiments may be implemented, in some cases, in hardware, firmware, software, or any combination thereof. The disclosed embodiments may also be implemented as instructions carried by or stored on one or more transitory or non-transitory machine-readable (e.g., computer-readable) storage media, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

Referring now to FIG. 1, in an illustrative embodiment, a system 100 for monitoring and analyzing vehicle traffic data includes one or more vehicles 102, one or more infrastructure sensors 110, and a traffic analysis server 108, each in communication over one or more networks 106. The vehicles 102 each include an in-vehicle computing system 104 that is capable of transmitting vehicle data (e.g., speed, trajectory, location, etc.) to the traffic analysis server 108 via one or more of the networks 106. Similarly, each of the infrastructure sensors 110 is capable of transmitting infrastructure data to the traffic analysis server 108 via the one or more of the networks 106. The infrastructure data may be embodied as any type of data indicative of a characteristic or aspect of the road segment 114 within which the infrastructure sensor 110 is located, or data from which a characteristic or aspect of the road segment 114 may be determined. For example, the infrastructure data may include, but is not limited to environment information (e.g., weather information, road conditions, etc.) and/or information relative to the vehicles 102 travelling through the road segment 114, such as a number of vehicles 102, travelling speeds of the vehicles 102, distances between the vehicles 102, lane changes made by the vehicles 102, etc.

In some embodiments, the system 100 may include one or more mobile computing devices 116, typically belonging to an occupant (e.g., a driver, an operator, a passenger, etc.) of a vehicle 102. As discussed in more detail below, the mobile computing devices 116 may be capable of providing additional vehicle data 102 to the traffic analysis server 108. For example, an application may be executed on a mobile computing device 116 that may also provide speed, trajectory, location, and/or other vehicle 102 related information to the traffic analysis server 108, which the traffic analysis server 108 may use to verify the vehicle data received from the in-vehicle computing system 104.

In use, the traffic analysis server 108 receives the vehicle data and the infrastructure data, and determines traffic patterns based on an analysis of the aggregated vehicle and infrastructure data over time. To do so, the traffic analysis server 108 divides each road 112 (e.g., an interstate highway, a state road, etc.) into a number of road segments 114. In some embodiments, the road segments 114 may be divided equally (e.g., each mile of a road, each city block, etc.). Additionally or alternatively, in some embodiments, the road segments 114 may be divided in unequal portions, such as between exits off of an interstate highway. For example, the traffic analysis server 108 may dynamically section off a stretch of the road 112 based on how heavy or light the traffic flow for a particular section of the stretch of the road 112. In such an example, the traffic analysis server 108 may section off a longer section of the road 112 that corresponds to a light traffic flow, while another section of the road 112 that corresponds to heavier traffic flow may be divided into several, smaller sections. In such embodiments, the traffic analysis server 108 may separate the road segments 114 using a machine learning algorithm, which may update the lengths of the particular road segments over time. Additionally, the traffic analysis server 108 determines the traffic patterns for each road segment 114 based on an analysis of the historical vehicle and infrastructure data for that road segment 114 at a given time, or for a given time window (e.g., a one-hour window of time, rush hour, morning, evening, etc.).

The traffic analysis server 108 additionally determines whether the received vehicle data and/or the infrastructure data is indicative of an anomaly, or deviation, from the expected traffic behavior based on the road segment 114 and a present time. To detect the anomaly, the traffic analysis server 108 compares the historical traffic patterns to present vehicle data and/or present infrastructure data. The traffic analysis server 108 further monitors the present vehicle data and/or present infrastructure data of adjacent road segments to the road segment 114 in which the anomaly was identified. Accordingly, the traffic analysis server 108 can track the identified anomaly and/or evaluate whether the detected anomaly is valid (e.g., a malicious hack of software of the vehicle 102, a malfunctioning component of the vehicle 102, etc.). Additionally, the traffic analysis server 108 evaluates whether the identified anomaly is associated with a particular vehicle 102, or group of vehicles 102, and may take further action (e.g., notify authorities, disable the vehicle(s) 102, etc.), if further action is required, based on a response policy associated with the anomaly.

In the illustrative system 100, the in-vehicle computing systems 104 of each of the vehicles 102 are additionally configured to facilitate the creation of an ad-hoc network 118. The ad-hoc network 118 facilitates communication between the in-vehicle computing system 104 of one vehicle 102 to the in-vehicle computing systems 104 of other vehicles 102. Additionally, in some embodiments, the in-vehicle computing systems 104 of other vehicles 102 may additionally provide vehicle information about another vehicle 102 to the traffic analysis server 108. In some embodiments, the ability to create ad-hoc networks 118 may be restricted, or limited, such as by a wireless range, a vehicle type (e.g., a brand, a company, a military branch, etc.), a communication protocol, etc.

Each vehicle 102 may be embodied as any type of vehicle that can travel along a road 112 and may include gasoline-powered cars, diesel-powered cars, natural gas powered vehicles, electric vehicles, all-terrain vehicles, motorcycles, and other types of vehicles. While the illustrative vehicle 102 is embodied as a vehicle capable of travelling on the road 112, it should be appreciated that, in some embodiments, the vehicle 102 may be embodied as any type of vehicle, such as a watercraft, an aircraft, a railway vehicle, etc. It should be further appreciated that, in some embodiments, the road 112 may refer to any type of traversable land, such as a dirt road, a gravel road, a paved road, etc.

Figure 2:
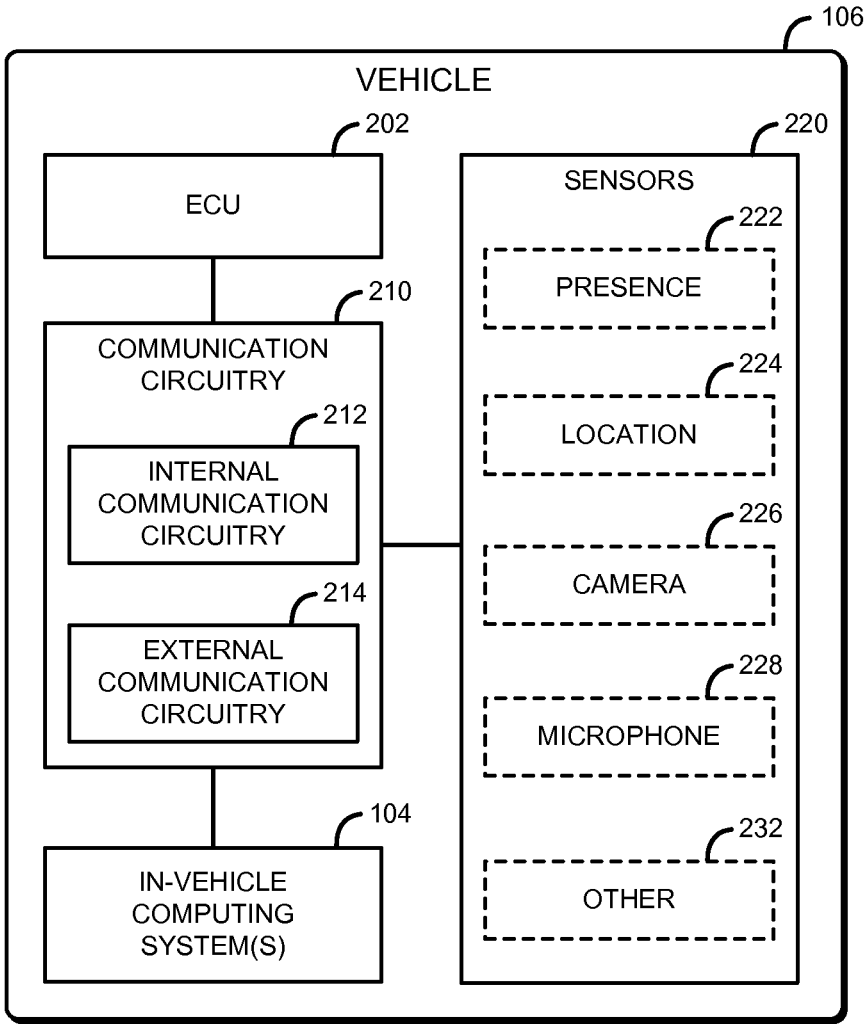
FIG. 2 is a simplified block diagram of at least one embodiment of a vehicle of the system of FIG. 1.

As shown in FIG. 2, the vehicle 102 includes an electronic control unit (ECU) 202, communication circuitry 210, a number of sensors 220, and the in-vehicle computing systems 104 of FIG. 1. It should be appreciated that the vehicle 102 may additionally include various other or additional components, such as those commonly found in a vehicle (e.g., an engine, a transmission, a drive shaft, axles, wheels, brakes, etc.), which are not illustrated herein to preserve clarity of the description. The ECU 202 may be embodied as any type of vehicle control unit, vehicle control circuit, or vehicle control computing device capable of performing the functions described herein. In use, the ECU 202 is configured to receive signals indicative of various operating parameters of the components of the vehicle 102 and/or a desired state of operation of the vehicle 102. The ECU 202 is additionally configured to determine control signals based on the received signals and provide the control signals to one or more of the components of the vehicle 102 to control operation of the vehicle 102. In some embodiments, the signals may be received from the sensors 220 of the vehicle 102 and/or inputs from an operator of the vehicle 102, for example, such as via the in-vehicle computing systems 104. Additionally or alternatively, in some embodiments, the signals may be received from an external source, such as the traffic analysis server 108 and/or the mobile computing device 116. It should be appreciated that, while the illustrative vehicle 102 includes a single ECU 202, in some embodiments, the vehicle 102 may include any number of ECUs 202 (e.g., an engine control module (ECM), a transmission control module (TCM), a powertrain control module (PCM), a brake control module (BCM), etc.) to control operation of the vehicle 102.

The illustrative communication circuitry 210 includes internal communication circuitry 212 and external communication circuitry 214. The internal communication circuitry 212 may be embodied as any communication circuit, device, or collection thereof, capable of facilitating internal communications to interconnect components of the vehicle 102, such as between the ECU 202 and the components of the vehicle 102, including the in-vehicle computing systems 104 and the sensors 220. For example, in some embodiments, the internal communication circuitry 212 may include a controller area network (CAN), a Local Interconnect Network (LIN), and/or the like. The external communication circuitry 214 may be embodied as any communication circuit, device, or collection thereof, capable of facilitating external communications between the vehicle 102 and a network (e.g., the network 106 of FIG. 1). The external communication circuitry 214 may be configured to use any one or more wireless communication technologies (e.g., mobile phone voice and data communication technologies) and cellular communication protocols (e.g., Code-Division Multiple Access (CDMA), Global System for Mobile Communications (GSM), etc.) and/or wireless protocols (e.g., Bluetooth®, Wi-Fi®, WiMAX), to effect such communication.

The sensors 220 may be embodied as any type of sensor capable of sensing and/or measuring operational data of the vehicle 102 and/or condition data of the road 112. In use, the sensors 220 are configured to supply electrical sensor data signals representing instantaneous values of sensed and/or measured information of the components of the vehicle 102 to the ECU 202. For example, in some embodiments, the sensors may be embodied as a presence sensor 222, a location sensor 224, a camera 226, a microphone 228, and/or any other sensors 230.

The presence sensor 222 may be configured as any type of sensor capable of detecting a physical reference external to the vehicle 102 and calculating a distance from the physical reference to the vehicle. The presence sensor may be embodied as a light measurement sensor, a photo sensor, a radar sensor, a laser sensor, etc. The location sensor 224 may be configured as any type of sensor capable of determining a present location of the vehicle 102. The camera 226 may be configured as any type of sensor capable of capturing image data. In some embodiments, the image data may include one or more traffic conditions and/or characteristics of the road 112, such as road type, road conditions, other vehicles 102, lane indicators, etc.

The microphone 228 may be configured as any type of sensor capable of capturing sounds made by the vehicle 102 and/or an occupant of the vehicle 102. For example, in some embodiments, the microphone 228 may sense voice commands by the driver to make an adjustment of the operation of the vehicle or interact with the in-vehicle computing systems 104. In some embodiments, the microphone 228 may additionally or alternatively sense road noise and/or engine noise. In some embodiments, the other sensors 230 may include any one or more sensors capable of measuring signals indicative of a state of a component of the vehicle 102 and/or matter throughput through a component of the vehicle 102, such as actuator position sensors, magnetic field sensors, flow sensors, pressure sensors, temperature sensors, speed sensors, particulate matter sensors, level sensors, and the like.

Referring again to FIG. 1, as described previously, each in-vehicle computing system 104 is associated with a vehicle 102. The in-vehicle computing systems 104 may be embodied as any type of in-vehicle computing device, or devices, capable of performing the functions described herein. In use, the in-vehicle computing systems 104 may be configured to provide and/or receive sensor-driven data to the operator and/or an external computing device (e.g., the traffic analysis server 108), and receive input commands from the operator, the traffic analysis server 108, and/or the module computing device 116. For example, the in-vehicle computing systems 104 may be embodied as a remote diagnostic communication system, a back-up camera display system, an in-vehicle infotainment system, a navigation system, a blind-spot monitoring system, a lane departure warning system, an in-vehicle security system, a park assist system, and/or another in-vehicle computing system. The in-vehicle computing systems 104 may be additionally configured to provide the received sensor data of the vehicle 102 to the traffic analysis server 108.

The network 106 may be embodied as any type of wired or wireless communication network, including cellular networks (e.g., Global System for Mobile Communications (GSM), 3G, Long Term Evolution (LTE), Worldwide Interoperability for Microwave Access (WiMAX), etc.), digital subscriber line (DSL) networks, cable networks (e.g., coaxial networks, fiber networks, etc.), telephony networks, local area networks (LANs) or wide area networks (WANs), global networks (e.g., the Internet), or any combination thereof. As previously described, each of the in-vehicle computing systems 104, the infrastructure sensors 110, and the mobile computing devices 116 are capable of communicating with the traffic analysis server 108 via the network 106. Accordingly, the network 106 may include any number of network devices (e.g., access points, routers, switches, servers, etc.) as needed to facilitate communication to and from the traffic analysis server 108.

The infrastructure sensors 110 may be embodied as any type of sensor capable of sensing environment data along a road segment 114 and/or externally monitoring vehicle traffic data of the vehicles 102 travelling through the road segment 114. The infrastructure sensors 110 may include, for example, traffic cameras, weather sensors, location sensors, weight sensors, radar sensors, speed sensors, traffic signal sensors, lane sensors, and/or any other type of sensor capable of sensing characteristics of the road segment 114 and or the vehicle traffic through the road segment 114.

The mobile computing device 116 may be embodied as any type of computing device capable of performing the functions described herein. For example, the mobile computing device 116 may be embodied as, without limitation, a smart phone, a tablet computer, a laptop computer, a notebook computer, a mobile computing device, a cellular telephone, a handset, a messaging device, a vehicle telematics device, a distributed computing system, a multiprocessor system, a consumer electronic device, and/or any other computing device configured to perform the functions described herein. In use, the mobile computing device 116 is configured to communicate with the in-vehicle computing systems 104 and/or the traffic analysis server 108. To do so, the mobile computing device may be configured to use any one or more wireless communication technologies (e.g., mobile phone voice and data communication technologies) and cellular communication protocols (e.g., Code-Division Multiple Access (CDMA), Global System for Mobile Communications (GSM), etc.) and/or wireless protocols (e.g., Bluetooth®, Wi-Fi®, WiMAX), to effect such communication.

The traffic analysis server 108 may be embodied as any type of computation or computing device capable of performing the functions described herein, including, without limitation, a server, a blade server, a computer, a desktop computer, a smartphone, a workstation, a laptop computer, a notebook computer, a tablet computer, a mobile computing device, a wearable computing device, a network appliance, a web appliance, a distributed computing system, a processor-based system, and/or a consumer electronic device. As will be described in further detail below, the traffic analysis server 108 is configured to communicate with the in-vehicle computing systems 104, the infrastructure sensors 110, and the mobile computing devices over the network 106.

Figure 3:
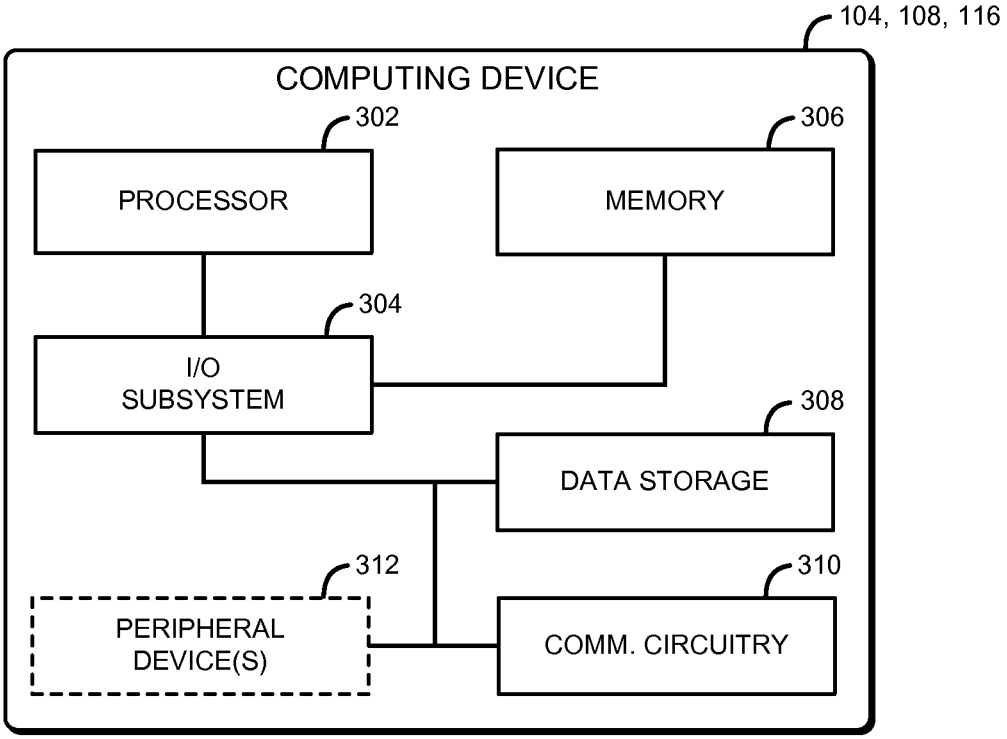
FIG. 3 is a simplified block diagram of at least one embodiment of a traffic analysis server of the system of FIG. 1.

Referring now to FIG. 3, each of the in-vehicle computing system 104, the traffic analysis server 108, and the mobile computing device 116 may have similar components to each other (although perhaps of different power and/or robustness). Those similar components are shown in FIG. 3 and discussed below in regard to the traffic analysis server 108 with the understanding that such description is equally applicable to the similar components of the in-vehicle computing system(s) 104 and the mobile computing device(s) 116.

As shown in FIG. 3, the traffic analysis server 108 includes a processor 302, an input/output (I/O) subsystem 304, a memory 306, a data storage device 308, and communication circuitry 310. The processor 302 may be embodied as any type of processor capable of performing the functions described herein. The processor 302 may be embodied as a single or multi-core processor(s), digital signal processor, microcontroller, or other processor or processing/controlling circuit.

The memory 306 may be embodied as any type of volatile or non-volatile memory or data storage capable of performing the functions described herein. In operation, the memory 306 may store various data and software used during operation of the traffic analysis server 108, such as operating systems, applications, programs, libraries, and drivers. The memory 306 is communicatively coupled to the processor 302 via the I/O subsystem 304, which may be embodied as circuitry and/or components to facilitate input/output operations with the processor 302, the memory 306, and other components of the traffic analysis server 108. For example, the I/O subsystem 304 may be embodied as, or otherwise include, memory controller hubs, input/output control hubs, firmware devices, communication links (i.e., point-to-point links, bus links, wires, cables, light guides, printed circuit board traces, etc.) and/or other components and subsystems to facilitate the input/output operations. In some embodiments, the I/O subsystem 304 may form a portion of a system-on-a-chip (SoC) and be incorporated, along with the processors 302, the memory 306, and other components of the traffic analysis server 108, on a single integrated circuit chip.

The data storage device 308 may be embodied as any type of device or devices configured for short-term or long-term storage of data such as, for example, memory devices and circuits, memory cards, hard disk drives, solid-state drives, or other data storage devices. In some embodiments, the data storage device 308 may be used to store the contents of one or more secure enclaves. When stored by the data storage device 308, the contents of the secure enclave may be encrypted to prevent unauthorized access.

The communication circuitry 310 of the traffic analysis server 108 may be embodied as any communication circuit, device, or collection thereof, capable of enabling communications between the traffic analysis server 108 and the in-vehicle computing systems 104, the infrastructure sensors 110, and/or the mobile computing devices 116 over the network 106. The communication circuitry 310 may be configured to use any one or more communication technology (e.g., wired or wireless communications) and associated protocols (e.g., Ethernet, Bluetooth®, Wi-Fi®, WiMAX, etc.) to effect such communication.

In some embodiments, the traffic analysis server 108 may additionally include one or more peripheral devices 312, such as a display (e.g., a liquid crystal display (LCD), a light emitting diode (LED), a plasma display, a cathode ray tube (CRT), etc.), a keyboard, a mouse, one or more data storage devices (e.g., an internal or external hard drive), and/or other user-interfacing I/O peripheral devices. The particular peripheral devices included in the peripheral devices 312 may depend upon, for example, the intended use of the traffic analysis server 108. For example, in some embodiments, the display may be coupled to a touch screen to allow the user to interact with the traffic analysis server 108. The peripheral devices 312 are communicatively coupled to the I/O subsystem 304 via a number of signal paths thereby allowing the I/O subsystem 304 and/or processor 302 to receive inputs from and send outputs to the peripheral devices 312.

Figure 4:
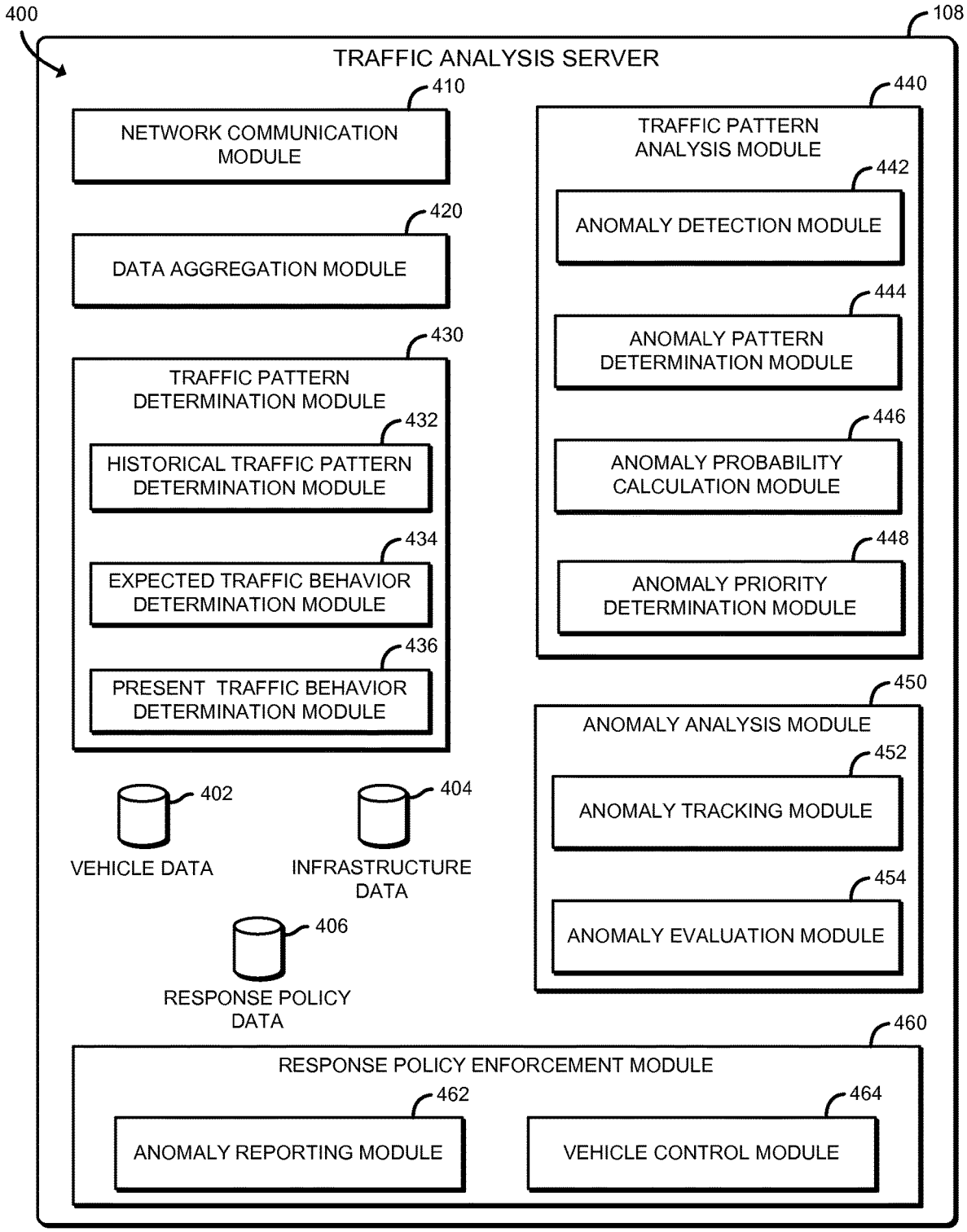
FIG. 4 is a simplified block diagram of at least one embodiment of an environment that may be established by the traffic analysis server of FIG. 3.

Referring now to FIG. 4, in an embodiment, the traffic analysis server 108 establishes an environment 400 during operation. The illustrative environment 400 includes a network communication module 410, a data aggregation module 420, a traffic pattern determination module 430, a traffic pattern analysis module 440, an anomaly analysis module 450, and a policy enforcement module 460. Each of the modules, logic, and other components of the environment 400 may be embodied as hardware, software, firmware, or a combination thereof. For example, each of the modules, logic, and other components of the environment 400 may form a portion of, or otherwise be established by, a processor or other hardware components of the traffic analysis server 108. As such, in some embodiments, one or more of the modules of the environment 400 may be embodied as a circuit or collection of electrical devices (e.g., a network communication circuit, a data aggregation circuit, a traffic pattern determination circuit, a traffic pattern analysis circuit, an anomaly analysis circuit, a policy enforcement circuit, etc.). The illustrative environment 400 additionally includes vehicle data 402, infrastructure data 404, and response policy data 406, each of which may be accessed by the various modules and/or sub-modules of the traffic analysis server 108. It should be appreciated that the traffic analysis server 108 may include other components, sub-components, modules, and devices commonly found in a computing device, which are not illustrated in FIG. 4 for clarity of the description.

The network communication module 410 is configured to facilitate inbound and outbound network communications (i.e., network packets) containing traffic data (e.g., the vehicle data, the infrastructure data, etc.) to and from the traffic analysis server 108. In other words, the network communication module 410 is configured to receive network packets containing the traffic data from a computing device (e.g., the in-vehicle computing systems 104, the infrastructure sensors 110, and the mobile computing device 116) and transmit network packets containing the command data (e.g., vehicle operation commands, sensor data query commands, etc.) to the in-vehicle computing systems 104 of the vehicles 102, the infrastructure sensors 110, and/or the mobile computing device 116. Accordingly, in some embodiments, at least a portion of the functionality of the network communication module 410 may be performed by the communication circuitry 310. The vehicle data may be embodied as any type of data that is indicative of operational characteristics of a vehicle 102. The operational characteristics may include a speed, a location, and any other sensor retrievable data of the vehicle 102. For example, the vehicle data may correspond to data indicative of a present state of a component of the vehicle, such as an actuator position, a flow level, a fluid level, a pressure level, a temperature level, a speed, etc.

The data aggregation module 420 is configured to collect and store the traffic data received by the traffic analysis server 108, such as from the in-vehicle computing systems 104, the infrastructure sensors 110, and/or the mobile computing devices 116. In some embodiments, the data aggregation module 420 may store the data based on an associated road segments 114 (i.e., divided sections of a road 112) and may include a timestamp associated with the time in which the traffic data (e.g., the vehicle data, the infrastructure data, etc.) was received. In some embodiments, the collected vehicle data may be stored in the vehicle data 402 and the infrastructure data may be stored in the infrastructure data 404. In other embodiments, the vehicle and infrastructure data may be stored in a single database.

The traffic pattern determination module 430 is configured to analyze historical traffic data (i.e., previously collected vehicle data and infrastructure data) to determine traffic patterns. To do so, the traffic pattern determination module 430 includes a historical traffic pattern determination module 432, an expected traffic behavior determination module 434, and a present traffic behavior determination module 436. The historical traffic pattern determination module 432 is configured to determine the historical traffic patterns based on the historical traffic data for a particular time window over the previous years in which the historical traffic data for that particular time window and road segment 114 has been collected. For example, the historical traffic patterns may include an average number of vehicles 102 that passed through the road segment 114 for that particular time window, an average rate of speed for the vehicles 102 that travelled along the road segment for that particular time window, etc.

The expected traffic behavior determination module 434 is configured to determine expected traffic behavior (e.g., expected traffic flow patterns) based on the traffic patterns. The expected traffic behavior may be any type of behaviors exhibited by the vehicles 102 travelling through a road segment 114 at a particular time that corresponds to a time in the future (i.e., one year later than the previous time the historical traffic data was analyzed). For example, the expected traffic behavior may include a characteristic of the traffic flow of the vehicles 102 travelling through the road segment 114, such as a density of the vehicles 102, an average rate of speed of the vehicles 102, an average distance between the vehicles 102, etc. In some embodiments, the expected traffic behavior determination module 434 may use hysteresis and/or various machine learning algorithms to predict expected traffic behavior for the road segment 114 based on the time (i.e., time and date) in which the traffic data was received and detect the anomalies based on the expected traffic behaviors.

The present traffic behavior determination module 436 is configured to determine a present traffic behavior based on present traffic data (i.e., presently collected vehicle data and infrastructure data) received by the traffic analysis server 108. Similar to the expected traffic behavior, the present traffic behavior may be any type of traffic related behavior exhibited by the vehicles 102 travelling through a road segment 114 at the present, or near-present, time that can be determined based on the present traffic data.

The traffic pattern analysis module 440 is configured to identify anomalies for each road segment 114. To do so, the traffic pattern analysis module 440 includes an anomaly detection module 442, an anomaly pattern determination module 444, an anomaly probability calculation module 446, and an anomaly priority determination module 448. The anomaly detection module 442 is configured to detect, or identify, anomalies based on a comparison between the expected traffic behavior and the present traffic behavior. The anomaly pattern determination module 444 is configured to create anomaly patterns for each road segment 114 based on the determined anomalies. The anomaly patterns may be any type of pattern that is indicative of a behavior of the anomaly over a period of time. The anomaly probability calculation module 446 is configured to calculate an anomaly probability for each of the identified anomalies. The anomaly probability is indicative of the likelihood that the corresponding anomaly would occur in the present traffic behavior. The anomaly priority determination module 448 is configured to sort the identified anomalies. In some embodiments, the detected anomalies with the highest probabilities may be sorted such that they are addressed first. For example, the detected anomalies may be sorted based on highest to lowest probability as determined by the calculated anomaly probability for each identified anomaly.

The anomaly analysis module 450 is configured to analyze the sorted anomalies based on the priority to determine whether the anomaly is a valid anomaly (i.e., the anomaly is verified that it exists). In other words, the anomaly analysis module 450 is configured to verify whether an anomaly is attributable to a verifiable factor, such as a malicious activity (e.g., a software hack of the software driving the ECU 202, the in-vehicle computing systems 104, etc.), a faulty component of the vehicle 102, etc. In some embodiments, the anomaly analysis module 450 may be further configured to verify whether the anomaly is valid in an order corresponding to the highest probability anomaly being verified before a lower probability anomaly (i.e., based on the sorted detected anomalies). The anomaly analysis module 450 includes an anomaly tracking module 452 and an anomaly evaluation module 454. The anomaly tracking module 452 is configured to track the anomaly across road segments 114 to identify one or more of the vehicles 102 that may be responsible for causing the anomaly. The anomaly evaluation module 454 is configured to evaluate the identified vehicle(s) to either confirm or deny the validity of the anomaly.

The response policy enforcement module 460 is configured to take an action on the identified vehicle(s) based on a policy of a confirmed anomaly. To do so, the response policy enforcement module 460 includes an anomaly reporting module 462 and a vehicle control module 464. The anomaly reporting module 462 is configured to report the identified vehicle(s) according to the corresponding policy. For example, the anomaly reporting module 462 may report the identified vehicle(s) to law enforcement, emergency services, vehicle dealers, vehicle manufacturers, vehicle service stations, etc., based on the response policy for that particular anomaly. Additionally, the anomaly reporting module 462 may report the anomaly to operators of the identified vehicle(s) to notify the operators of the anomaly to either confirm the anomaly or to notify that an action is about to be taken on the identified vehicle(s). The vehicle control module 464 is configured to assume control of the identified vehicle(s) and take an action based on the response policy associated with the anomaly. For example, the vehicle control module 464 may send a kill command to the identified vehicle(s) that causes the identified vehicle(s) to reduce speed and/or change direction. In some embodiments, the policies may be stored at the response policy data 406.

Figure 5:
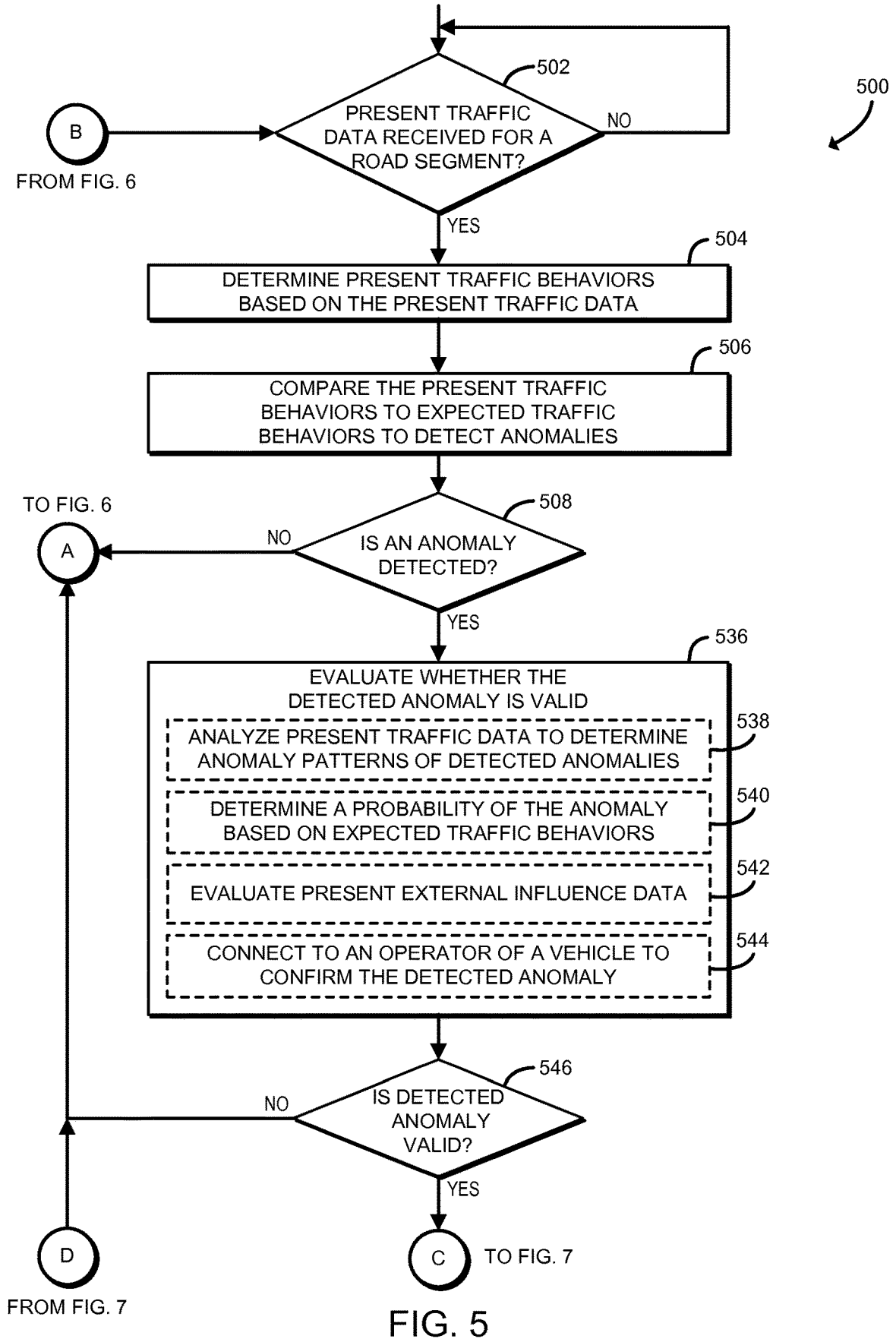
FIGS. 5-7 are a simplified flow diagram of at least one embodiment of a method for identifying anomalies in vehicle traffic data that may be executed by the traffic analysis server of FIG. 3.

Referring now to FIG. 5, in use, the traffic analysis server 108 may execute a method 500 for identifying anomalies in vehicle traffic data. The illustrative method 500 begins at block 502, in which the traffic analysis server 108 determines whether present traffic data (e.g., vehicle data, infrastructure data, etc.) is received for a particular road segment (e.g., the road segment 114 of FIG. 1). As described previously, the present traffic data may be received by the traffic analysis server 108 from various sources, including the in-vehicle computing systems 104, the infrastructure sensors 110, and/or the mobile computing devices 116. If the present traffic data has not been received, the method 500 loops back to block 502, to continue to determine whether the traffic analysis server 108 has received present traffic data for a particular road segment. Otherwise, the method 500 advances to block 504, wherein the traffic analysis server 108 determines present traffic behavior based on the present traffic data. The present traffic behavior may be embodied as or otherwise include data indicative of any type of traffic related behavior exhibited by the vehicles 102 travelling through the road segment 114 that can be determined using the present traffic data.

Figure 6:
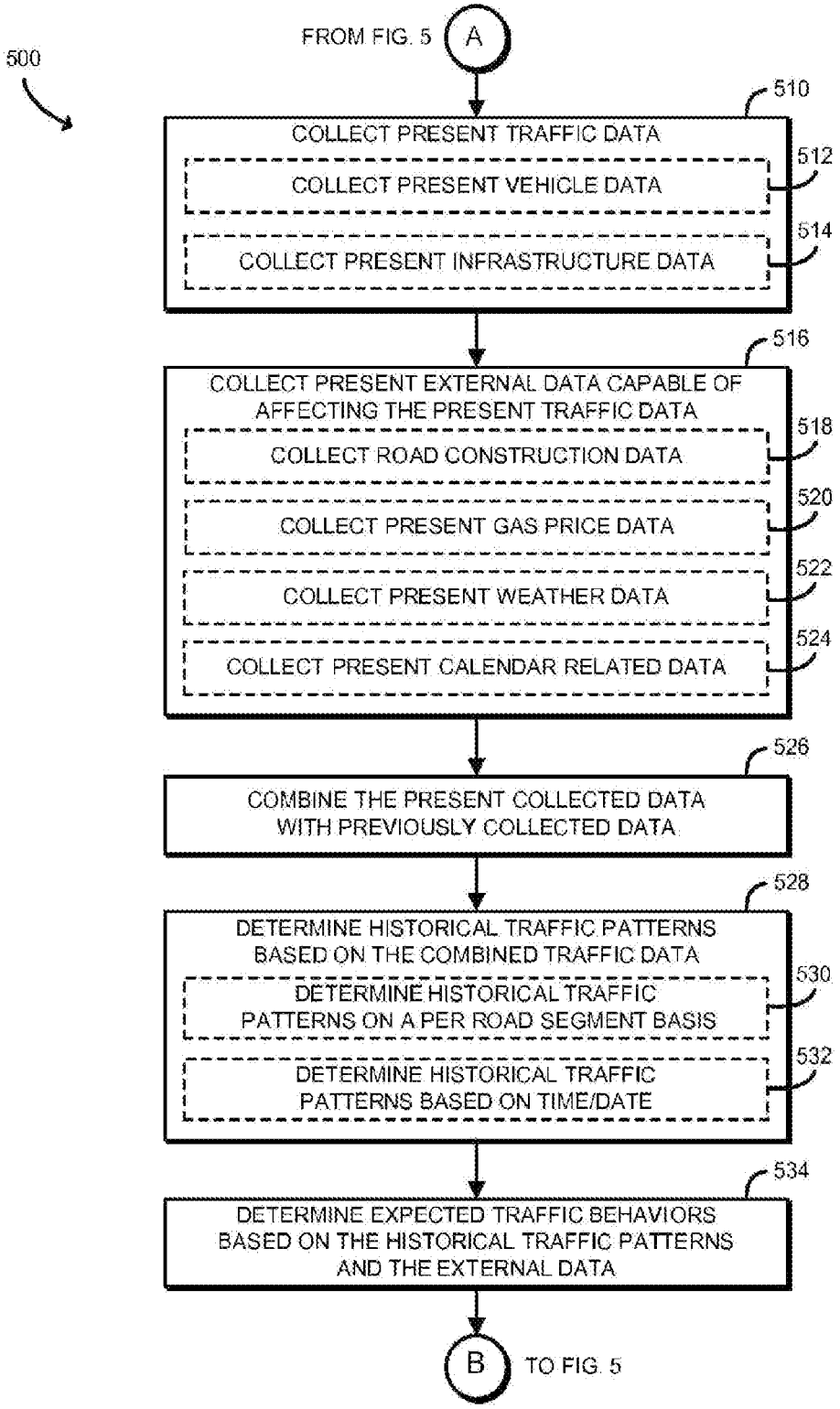

At block 506, the traffic analysis server 108 compares the present traffic behavior determined at block 504 to historical traffic patterns to detect anomalies for the road segment 114. At block 508, the traffic analysis server 108 determines whether an anomaly was detected. If not, the method 500 advances to block 510, shown in FIG. 6, wherein the traffic analysis server 108 collects the present traffic data received at block 502. In some embodiments, at block 512, the traffic analysis server 108 collects the present vehicle data. Additionally or alternatively, in some embodiments, at block 514, the traffic analysis server 108 collects the present infrastructure data.

At block 516, the traffic analysis server 108 additionally collects present external influence data capable of affecting the present traffic data. The external influence data may be any type of date that is indicative of factors capable of affecting the vehicle data or the infrastructure data. The traffic analysis server 108 may receive such external influence data from a remote source, such as the infrastructure sensors 110 of FIG. 1, or other sources from which the external influence data can be ascertained. For example, crowd-sourced information may be retrieved from applications capable of being executed on the mobile computing devices 116 of FIG. 1. In another example, the external influence data may be retrieved from various entities responsible for tracking such external influence data, such as from web servers the entities manage that the traffic analysis server 108 may extract the data from.

Examples of the present external influence data that may be collected are described at blocks 518-524. In some embodiments, at block 518, the traffic analysis server 108 may collect road construction data for each segment. Additionally or alternatively, in some embodiments, at block 520, the traffic analysis server 108 may collect present gas price data (e.g., a price per gallon). In some embodiments, at block 522, the traffic analysis server 108 may additionally or alternatively collect present weather data (e.g., rainy conditions, foggy conditions, snowy conditions, below freezing conditions, etc.). Additionally or alternatively, at block 524, the traffic analysis server 108 may collect present calendar related data, in some embodiments. For example, the present calendar related data may be indicative of whether the present day is a holiday, a weekday, a workday, typically a vacationing day, etc. At block 526, the traffic analysis server 108 combines the present collected data at blocks 510 and 516 with previously collected data. For example, the combined data may be allocated based on a time window in which the data was collected and/or a particular road segment.

At block 528, the traffic analysis server 108 determines historical traffic patterns based on the combined traffic data. In some embodiments, at block 530, the traffic analysis server 108 may determine the traffic patterns on a per road segment 114 basis. Additionally or alternatively, in some embodiments, at block 532, the traffic analysis server 108 may determine the traffic patterns based on a date and time. For example, the traffic analysis server 108 may analyze the historical traffic data for a particular time window over the years in which the historical traffic data and/or external influence data for that particular time window has been collected. At block 534, the traffic analysis server 108 determines expected traffic behavior based on the historical traffic patterns and external influence data. The expected traffic behavior may be any type of behaviors exhibited by the vehicles 102 travelling through a road segment 114 at a particular time that corresponds to a time in the future (i.e., one year later than the previous time the historical traffic data was analyzed). For example, the expected traffic behavior may include a characteristic of the traffic flow of the vehicles 102 travelling through the road segment 114, such as a density of the vehicles 102, an average rate of speed of the vehicles 102, an average distance between the vehicles 102, etc. In some embodiments, the traffic analysis server 108 may use hysteresis and/or various machine learning algorithms to predict expected traffic behavior for the road segment 114 based on the time (i.e., time and date) in which the traffic data was received and detect the anomalies based on the expected traffic behavior. Additionally, the traffic analysis server 108 may adjust the expected traffic behavior based on the historical external influence data. From block 534, the method 500 returns to block 502, wherein the traffic analysis server 108 determines whether present traffic data for a particular road segment has been received.

Referring again to FIG. 5, if at block 508 the traffic analysis server 108 detects an anomaly, the method 500 advances to block 536. At block 536, the traffic analysis server 108 evaluates whether the detected anomaly is valid. In other words, the traffic analysis server 108 verifies whether the anomaly is attributable to a verifiable factor, such as a malicious hack, a faulty component of the vehicle 102, etc. In some embodiments, at block 538, the traffic analysis server 108 may determine anomaly patterns based on the detected the anomalies. The anomaly patterns may be any type of pattern is indicative of a behavior of the anomaly over a period of time. Additionally or alternatively, in some embodiments, at block 540, the traffic analysis server 108 may determine a probability of the anomaly based on the expected traffic behavior. In some embodiments, at block 542, the traffic analysis server 108 may additionally or alternatively evaluate present external influence data capable of affecting the present traffic data to validate the detected anomaly. For example, the traffic analysis server 108 may evaluate whether present weather conditions are affecting the traffic data, such that the anomaly may be attributable to the present weather conditions. In another example, the traffic analysis server 108 may determine evaluate whether the present day falls on a day (e.g., a holiday, a weekend, etc.) that is inconsistent with the previously collected traffic data from which the traffic patterns were determined. Additionally or alternatively, in some embodiments, at block 544, the traffic analysis server 108 may connect to an operator of a vehicle to confirm the detected anomaly. For example, the traffic analysis server 108 may connect to an operator of a vehicle 102 in the road segment 114 (e.g., via the in-vehicle computing system 104 of the other vehicle and/or a mobile computing device 116 of an operator of the other vehicle) to verify the anomaly with the operator of the vehicle 102.

Figure 7:
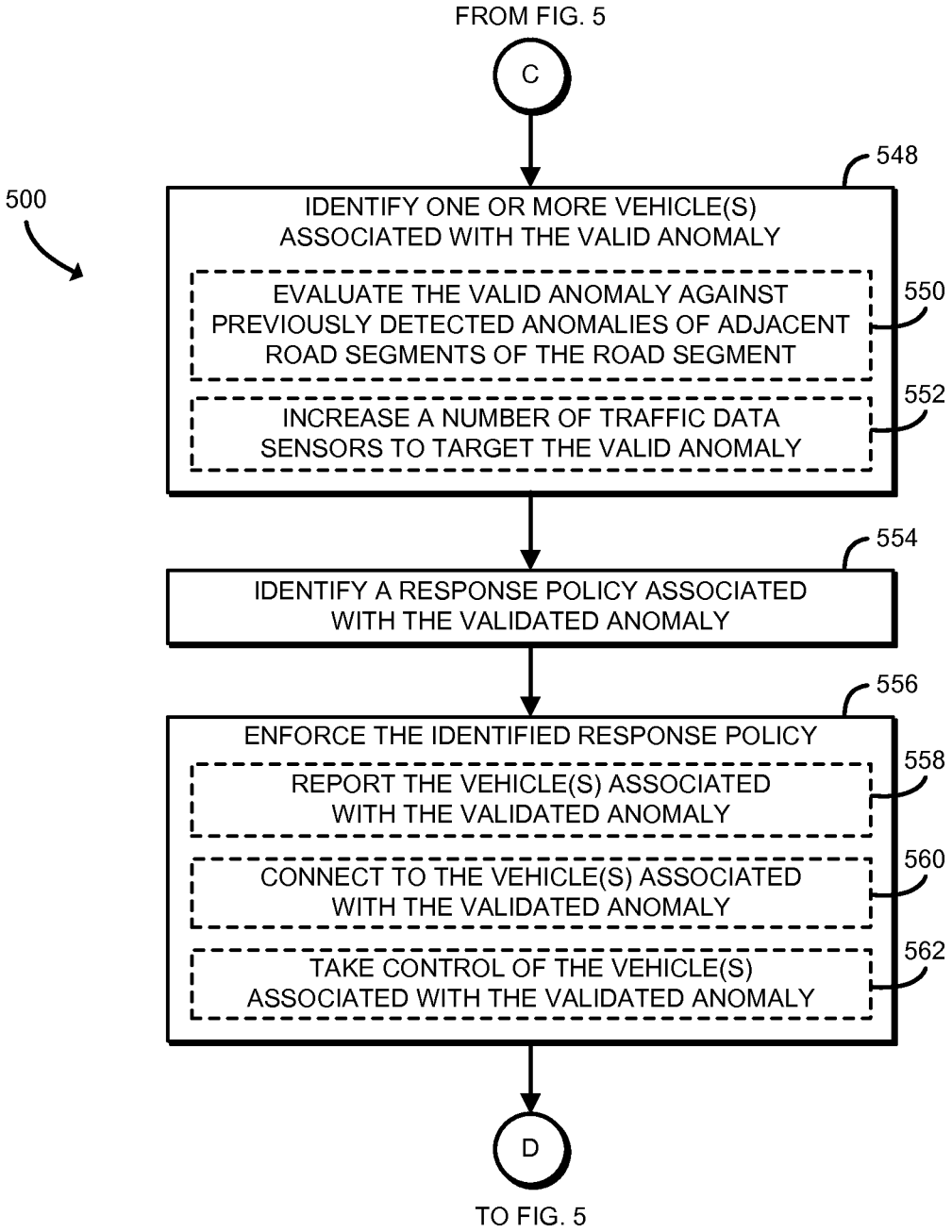

At block 546, the traffic analysis server 108 determines whether the detected anomaly was validated based on the evaluation at block 538. If not, the method 500 advances to block 512, wherein the present traffic data is collected. If the traffic analysis server 108 determines that the detected anomaly was valid, the method advances to block 548 of FIG. 7, wherein the traffic analysis server 108 identifies one or more vehicle(s) 102 associated with the anomaly validated at block 538.

In some embodiments, at block 550, the traffic analysis server 108 may evaluate the detected anomaly against previously detected anomalies of adjacent road segments to the road segment 114 in an attempt to identify which vehicle(s) 102 may be the cause of the anomaly. Additionally or alternatively, in some embodiments, the traffic analysis server 108 may provide an indication to an in-vehicle computing system 104 of one or more vehicles 102 and/or infrastructure sensors 110 in the road segment to target one or more suspected vehicles to identify which vehicle(s) 102 may be the cause of the anomaly.

At block 554, the traffic analysis server 108 identifies a policy associated with the validated anomaly. At block 556, the traffic analysis server 108 enforces the identified policy. In some embodiments, at block 558, the traffic analysis server 108 may report the vehicle(s) associated with the validated anomaly. For example, the traffic analysis server 108 may report the vehicle(s) 102 associated with the validated anomaly to law enforcement, emergency services, vehicle dealers, vehicle manufacturers, vehicle service stations, etc. based on a response policy for that identified anomaly and the vehicle(s) 102 identified as the cause of the validated anomaly. Additionally or alternatively, at block 560, the traffic analysis server 108 may, in some embodiments, connect to the vehicle(s) 102 associated with the validated anomaly. For example, the traffic analysis server 108 may connect to an affected vehicle 102 via the in-vehicle computing system 104 of the affected vehicle and/or a mobile computing device 108 of an operator of the vehicle 102 to warn the operator of the anomaly and/or to verify the anomaly with the operator of the vehicle 102. In some embodiments, at block 562, the traffic analysis server 108 may additionally or alternatively take control of the vehicle(s) 102 determined to be associated with the validated anomaly. For example, the traffic analysis server 108 may send a kill command to the vehicle(s) 102 determined to be associated with the validated anomaly to force the vehicle(s) 102 to slow down and pull over to the side of the road 112.

EXAMPLES

Illustrative examples of the technologies disclosed herein are provided below. An embodiment of the technologies may include any one or more, and any combination of, the examples described below.

Example 1 includes a computing device for monitoring vehicle traffic, the computing device comprising a network communication module to receive infrastructure data from one or more infrastructure sensors associated with a road segment of a road vehicle data from one or more vehicles located on the road segment, wherein the infrastructure data is indicative of a characteristic of the road segment, and wherein the vehicle data is indicative of operational characteristics of the corresponding vehicle while the corresponding vehicle traverses the road segment; a traffic pattern determination module to (i) determine a present traffic behavior for the road segment based on the vehicle data and the infrastructure data and (ii) determine an expected traffic behavior for the road segment based on a historical traffic pattern associated with the road segment, wherein the historical traffic pattern is based on historical vehicle data and historical infrastructure data captured during a prior time period; and a traffic pattern analysis module to determine whether an anomaly has occurred in the present traffic behavior based on a comparison of the present traffic behavior and the expected traffic behavior.

Example 2 includes the subject matter of Example 1, and wherein to determine the expected traffic behavior comprises to (i) receive infrastructure data from the one or more infrastructure sensors during the prior time period, (ii) receive vehicle data from one or more vehicles located on the road segment during the prior time period, and (iii) generate the historical traffic pattern associated with the road segment for the prior period of time based on an analysis of the infrastructure data and the vehicle data received during the prior time period.

Example 3 includes the subject matter of any of Examples 1 and 2, and, wherein to determine the expected traffic behavior comprises to receive external influence data from a remote source during the prior time period, wherein the external influence data is indicative of factors capable of affecting the vehicle data or the infrastructure data.

Example 4 includes the subject matter of any of Examples 1-3, and wherein to generate the historic traffic pattern comprises to generate the historical traffic pattern associated with the road segment for the prior period of time based on an analysis of the infrastructure data, the vehicle data, and the external influence data.

Example 5 includes the subject matter of any of Examples 1-4, and wherein the network communication module is further to receive external influence data from a remote source while the corresponding vehicle traverses the road segment, wherein the external influence data is indicative of factors capable of affecting the vehicle data or the infrastructure data, and wherein to determine the present traffic behavior for the road segment comprises to determine a present traffic behavior for the road segment based on the vehicle data, the infrastructure data, and the external influence data.

Example 6 includes the subject matter of any of Examples 1-5, and wherein to receive the vehicle data from the one or more vehicles located on the road segment comprises to receive vehicle data from an in-vehicle computing system of at least one of the vehicles located on the road segment while the at least one of the vehicles traverses the road segment.

Example 7 includes the subject matter of any of Examples 1-6, and wherein to receive the vehicle data from the one or more vehicles located on the road segment comprises to receive vehicle data from a mobile computing device located in at least one of the vehicles located on the road segment while the at least one of the vehicles traverses the road segment.

Example 8 includes the subject matter of any of Examples 1-7, and further including an anomaly analysis module to identify one or more vehicles associated with the anomaly in response to determining that the anomaly has occurred.

Example 9 includes the subject matter of any of Examples 1-8, and wherein to identify the one or more vehicles associated with the anomaly comprises to track the anomaly across adjacent road segments of the road.

Example 10 includes the subject matter of any of Examples 1-9, and further including an anomaly analysis module to determine whether the anomaly is a valid anomaly in response to determining that the anomaly has occurred.

Example 11 includes the subject matter of any of Examples 1-10, and wherein to determine whether the anomaly is a valid anomaly comprises to analyze external influence data indicative of factors capable of affecting the vehicle data or the infrastructure data.

Example 12 includes the subject matter of any of Examples 1-11, and wherein to determine whether the anomaly is a valid anomaly comprises to (i) generate an anomaly pattern for anomaly, wherein the anomaly pattern is indicative of a behavior of the anomaly over a period of time, and (ii) determine whether the anomaly is a valid anomaly based on the anomaly pattern.

Example 13 includes the subject matter of any of Examples 1-12, and wherein to determine whether the anomaly is a valid anomaly comprises to (i) calculate an anomaly probability for a plurality of anomalies that may occur in the present traffic behavior, wherein each anomaly probability is indicative of the likelihood that the corresponding anomaly would occur in the present traffic behavior, (ii) rank the plurality of anomalies based on the anomaly probability associated with each anomaly of the plurality of anomalies, and (iii) determine whether the determined anomaly is a valid anomaly based on the ranking of the plurality of anomalies.

Example 14 includes the subject matter of any of Examples 1-13, and further including an anomaly analysis module to (i) determine whether the anomaly is a valid anomaly in response to determining that the anomaly has occurred and (ii) identify one or more vehicles associated with the anomaly in response to determining that the anomaly is a valid anomaly; and a policy enforcement module to enforce a response policy against the one or more identified vehicles.

Example 15 includes the subject matter of any of Examples 1-14, and wherein to enforce the response policy comprises to report the one or more identified vehicles to an authority.

Example 16 includes the subject matter of any of Examples 1-15, and wherein to enforce the response policy comprises to communicate with the one or more identified vehicles to notify operators of the one or more identified vehicles of the determined anomaly.

Example 17 includes the subject matter of any of Examples 1-16, and wherein to enforce the response policy comprises to communicate with the one or more identified vehicles to assume control of the one or more identified vehicles.

Example 18 includes the subject matter of any of Examples 1-17, and wherein to assume control of the one or more identified vehicles comprises to transmit a kill command to the one or more identified vehicles, wherein the kill command causes the one or more vehicles to (i) reduce in speed or (ii) change direction.

Example 19 includes the subject matter of any of Examples 1-18, and wherein to receive the infrastructure data from one or more infrastructure sensors associated with the road segment comprises to receive infrastructure data from at least one of a traffic camera, a weather sensor, a location sensor, a weight sensor, a radar sensor, a speed sensor, a traffic signal sensor, or a lane sensor.

Example 20 includes a method for monitoring vehicle traffic, the method comprising receiving, by a traffic analysis server, infrastructure data from one or more infrastructure sensors associated with a road segment of a road, wherein the infrastructure data is indicative of a characteristic of the road segment; receiving, by the traffic analysis server, vehicle data from one or more vehicles located on the road segment, wherein the vehicle data is indicative of operational characteristics of the corresponding vehicle while the corresponding vehicle traverses the road segment; determining, by the traffic analysis server, a present traffic behavior for the road segment based on the vehicle data and the infrastructure data; determining, by the traffic analysis server, an expected traffic behavior for the road segment based on a historical traffic pattern associated with the road segment, wherein the historical traffic pattern is based on historical vehicle data and historical infrastructure data captured during a prior time period; and determining, by the traffic analysis server, whether an anomaly has occurred in the present traffic behavior based on a comparison of the present traffic behavior and the expected traffic behavior.

Example 21 includes the subject matter of Example 20, and wherein determining the expected traffic behavior comprises receiving, by the traffic analysis server, infrastructure data from the one or more infrastructure sensors during the prior time period, receiving, by the traffic analysis server, vehicle data from one or more vehicles located on the road segment during the prior time period, and generating, by the traffic analysis server, the historical traffic pattern associated with the road segment for the prior period of time based on an analysis of the infrastructure data and the vehicle data received during the prior time period.

Example 22 includes the subject matter of any of Examples 20 and 21, and wherein determining the expected traffic behavior comprises receiving, by the traffic analysis server, external influence data from a remote source during the prior time period, wherein the external influence data is indicative of factors capable of affecting the vehicle data or the infrastructure data.

Example 23 includes the subject matter of any of Examples 20-22, and wherein generating the historic traffic pattern comprises generating, by the traffic analysis server, the historical traffic pattern associated with the road segment for the prior period of time based on an analysis of the infrastructure data, the vehicle data, and the external influence data.

Example 24 includes the subject matter of any of Examples 20-23, and further including receiving, by the traffic analysis server, external influence data from a remote source while the corresponding vehicle traverses the road segment, wherein the external influence data is indicative of factors capable of affecting the vehicle data or the infrastructure data, and wherein determining the present traffic behavior for the road segment comprises determining, by the traffic analysis server, a present traffic behavior for the road segment based on the vehicle data, the infrastructure data, and the external influence data.

Example 25 includes the subject matter of any of Examples 20-24, and wherein receiving the vehicle data from the one or more vehicles located on the road segment comprises receiving vehicle data from an in-vehicle computing system of at least one of the vehicles located on the road segment while the at least one of the vehicles traverses the road segment.

Example 26 includes the subject matter of any of Examples 20-25, and wherein receiving the vehicle data from the one or more vehicles located on the road segment comprises receiving vehicle data from a mobile computing device located in at least one of the vehicles located on the road segment while the at least one of the vehicles traverses the road segment.

Example 27 includes the subject matter of any of Examples 20-26, and further including identifying, by the traffic analysis server, one or more vehicles associated with the anomaly in response to determining that the anomaly has occurred.

Example 28 includes the subject matter of any of Examples 20-27, and wherein identifying the one or more vehicles associated with the anomaly comprises tracking the anomaly across adjacent road segments of the road.

Example 29 includes the subject matter of any of Examples 20-28, and further including determining, by the traffic analysis server, whether the anomaly is a valid anomaly in response to determining that the anomaly has occurred.

Example 30 includes the subject matter of any of Examples 20-29, and wherein determining whether the anomaly is a valid anomaly comprises analyzing, by the traffic analysis server, external influence data indicative of factors capable of affecting the vehicle data or the infrastructure data.

Example 31 includes the subject matter of any of Examples 20-30, and wherein determining whether the anomaly is a valid anomaly comprises generating, by the traffic analysis server, an anomaly pattern for anomaly, wherein the anomaly pattern is indicative of a behavior of the anomaly over a period of time, and determining, by the traffic analysis server, whether the anomaly is a valid anomaly based on the anomaly pattern.

Example 32 includes the subject matter of any of Examples 20-31, and wherein determining whether the anomaly is a valid anomaly comprises calculating, by the traffic analysis server, an anomaly probability for a plurality of anomalies that may occur in the present traffic behavior, wherein each anomaly probability is indicative of the likelihood that the corresponding anomaly would occur in the present traffic behavior, ranking the plurality of anomalies based on the anomaly probability associated with each anomaly of the plurality of anomalies, and determining whether the determined anomaly is a valid anomaly based on the ranking of the plurality of anomalies.

Example 33 includes the subject matter of any of Examples 20-32, and further including determining, by the traffic analysis server, whether the anomaly is a valid anomaly in response to determining that the anomaly has occurred, identifying, by the traffic analysis server, one or more vehicles associated with the anomaly in response to determining that the anomaly is a valid anomaly, and enforcing a response policy against the one or more identified vehicles.

Example 34 includes the subject matter of any of Examples 20-33, and wherein enforcing the response policy comprises reporting the one or more identified vehicles to an authority.

Example 35 includes the subject matter of any of Examples 20-34, and wherein enforcing the response policy comprises communicating with the one or more identified vehicles to notify operators of the one or more identified vehicles of the determined anomaly.

Example 36 includes the subject matter of any of Examples 20-35, and wherein enforcing the response policy comprises communicating with the one or more identified vehicles to assume control of the one or more identified vehicles.

Example 37 includes the subject matter of any of Examples 20-36, and wherein assuming control of the one or more identified vehicles comprises transmitting a kill command to the one or more identified vehicles, wherein the kill command causes the one or more vehicles to (i) reduce in speed or (ii) change direction.

Example 38 includes the subject matter of any of Examples 20-37, and wherein receiving the infrastructure data from one or more infrastructure sensors associated with the road segment comprises receiving, by the traffic analysis server, infrastructure data from at least one of a traffic camera, a weather sensor, a location sensor, a weight sensor, a radar sensor, a speed sensor, a traffic signal sensor, or a lane sensor.

Example 39 includes a computing device comprising a processor; and a memory having stored therein a plurality of instructions that when executed by the processor cause the computing device to perform the method of any of Examples 20-38.

Example 40 includes one or more machine readable storage media comprising a plurality of instructions stored thereon that in response to being executed result in a computing device performing the method of any of Examples 20-38.

Example 41 includes a computing device for monitoring vehicle traffic, the computing device comprising means for receiving infrastructure data from one or more infrastructure sensors associated with a road segment of a road, wherein the infrastructure data is indicative of a characteristic of the road segment; means for receiving vehicle data from one or more vehicles located on the road segment, wherein the vehicle data is indicative of operational characteristics of the corresponding vehicle while the corresponding vehicle traverses the road segment; means for determining a present traffic behavior for the road segment based on the vehicle data and the infrastructure data; means for determining an expected traffic behavior for the road segment based on a historical traffic pattern associated with the road segment, wherein the historical traffic pattern is based on historical vehicle data and historical infrastructure data captured during a prior time period; and means for determining whether an anomaly has occurred in the present traffic behavior based on a comparison of the present traffic behavior and the expected traffic behavior.

Example 42 includes the subject matter of Example 41, and wherein the means for determining the expected traffic behavior comprises means for receiving infrastructure data from the one or more infrastructure sensors during the prior time period, means for receiving vehicle data from one or more vehicles located on the road segment during the prior time period, and means for generating the historical traffic pattern associated with the road segment for the prior period of time based on an analysis of the infrastructure data and the vehicle data received during the prior time period.

Example 43 includes the subject matter of any of Examples 41 and 42, and wherein the means for determining the expected traffic behavior comprises means for receiving external influence data from a remote source during the prior time period, wherein the external influence data is indicative of factors capable of affecting the vehicle data or the infrastructure data.

Example 44 includes the subject matter of any of Examples 41-43, and wherein the means for generating the historic traffic pattern comprises means for generating the historical traffic pattern associated with the road segment for the prior period of time based on an analysis of the infrastructure data, the vehicle data, and the external influence data.

Example 45 includes the subject matter of any of Examples 41-44, and further including means for receiving, by the traffic analysis server, external influence data from a remote source while the corresponding vehicle traverses the road segment, wherein the external influence data is indicative of factors capable of affecting the vehicle data or the infrastructure data, and wherein the means for determining the present traffic behavior for the road segment comprises means for determining a present traffic behavior for the road segment based on the vehicle data, the infrastructure data, and the external influence data.

Example 46 includes the subject matter of any of Examples 41-45, and wherein the means for receiving the vehicle data from the one or more vehicles located on the road segment comprises means for receiving vehicle data from an in-vehicle computing system of at least one of the vehicles located on the road segment while the at least one of the vehicles traverses the road segment.

Example 47 includes the subject matter of any of Examples 41-46, and wherein the means for receiving the vehicle data from the one or more vehicles located on the road segment comprises means for receiving vehicle data from a mobile computing device located in at least one of the vehicles located on the road segment while the at least one of the vehicles traverses the road segment.

Example 48 includes the subject matter of any of Examples 41-47, and further including means for identifying, by the traffic analysis server, one or more vehicles associated with the anomaly in response to determining that the anomaly has occurred.

Example 49 includes the subject matter of any of Examples 41-48, and wherein the means for identifying the one or more vehicles associated with the anomaly comprises means for tracking the anomaly across adjacent road segments of the road.

Example 50 includes the subject matter of any of Examples 41-49, and further including means for determining, by the traffic analysis server, whether the anomaly is a valid anomaly in response to determining that the anomaly has occurred.

Example 51 includes the subject matter of any of Examples 41-50, and wherein the means for determining whether the anomaly is a valid anomaly comprises means for analyzing external influence data indicative of factors capable of affecting the vehicle data or the infrastructure data.

Example 52 includes the subject matter of any of Examples 41-51, and wherein the means for determining whether the anomaly is a valid anomaly comprises means for generating an anomaly pattern for anomaly, wherein the anomaly pattern is indicative of a behavior of the anomaly over a period of time, and means for determining whether the anomaly is a valid anomaly based on the anomaly pattern.

Example 53 includes the subject matter of any of Examples 41-52, and wherein the means for determining whether the anomaly is a valid anomaly comprises means for calculating an anomaly probability for a plurality of anomalies that may occur in the present traffic behavior, wherein each anomaly probability is indicative of the likelihood that the corresponding anomaly would occur in the present traffic behavior, means for ranking the plurality of anomalies based on the anomaly probability associated with each anomaly of the plurality of anomalies, and means for determining whether the determined anomaly is a valid anomaly based on the ranking of the plurality of anomalies.

Example 54 includes the subject matter of any of Examples 41-53, and further including means for determining whether the anomaly is a valid anomaly in response to determining that the anomaly has occurred, means for identifying one or more vehicles associated with the anomaly in response to determining that the anomaly is a valid anomaly, and means for enforcing a response policy against the one or more identified vehicles.

Example 55 includes the subject matter of any of Examples 41-54, and wherein the means for enforcing the response policy comprises means for reporting the one or more identified vehicles to an authority.

Example 56 includes the subject matter of any of Examples 41-55, and wherein the means for enforcing the response policy comprises means for communicating with the one or more identified vehicles to notify operators of the one or more identified vehicles of the determined anomaly.

Example 57 includes the subject matter of any of Examples 41-56, and wherein the means for enforcing the response policy comprises means for communicating with the one or more identified vehicles to assume control of the one or more identified vehicles.

Example 58 includes the subject matter of any of Examples 41-57, and wherein the means for assuming control of the one or more identified vehicles comprises means for transmitting a kill command to the one or more identified vehicles, wherein the kill command causes the one or more vehicles to (i) reduce in speed or (ii) change direction.

Example 59 includes the subject matter of any of Examples 41-58, and wherein the means for receiving the infrastructure data from one or more infrastructure sensors associated with the road segment comprises means for receiving, by the traffic analysis server, infrastructure data from at least one of a traffic camera, a weather sensor, a location sensor, a weight sensor, a radar sensor, a speed sensor, a traffic signal sensor, or a lane sensor.

The invention claimed is:

1. A computing device for monitoring vehicle traffic, the computing device comprising:

a network communication module to receive infrastructure data from one or more infrastructure sensors associated with a road segment of a road and vehicle data from one or more vehicles located on the road segment, wherein the infrastructure data is indicative of a characteristic of the road segment, and wherein the vehicle data is indicative of operational characteristics of a corresponding vehicle while the corresponding vehicle traverses the road segment;

a traffic pattern determination module to (i) determine a present traffic behavior for the road segment based on the vehicle data and the infrastructure data and (ii) determine an expected traffic behavior for the road segment based on a historical traffic pattern associated with the road segment, wherein the historical traffic pattern is based on historical vehicle data and historical infrastructure data captured by the one or more infrastructure sensors during a prior time period;

a traffic pattern analysis module to determine whether an anomaly has occurred in the present traffic behavior based on a comparison of the present traffic behavior and the expected traffic behavior;

an anomaly analysis module to:

determine whether the anomaly is a valid anomaly that corresponds to hacking activity by:

(i) calculating an anomaly probability for a plurality of anomalies that may occur in the present traffic behavior, wherein each anomaly probability is indicative of a likelihood that the corresponding anomalies would occur in the present traffic behavior, (ii) ranking the plurality of anomalies based on the anomaly probability associated with each anomaly of the plurality of anomalies to identify higher ranking ones of the plurality of anomalies, and (iii) comparing the anomaly with another detected anomaly that previously occurred on another road segment of the road, the another road segment adjacent the road segment; and a policy enforcement module to enforce a response policy against the at least one of the one or more vehicles, wherein the response policy maps anomalies to corresponding response actions based on a state of the at least one of the one or more vehicles, and wherein at least one of the corresponding response actions includes communicating with the at least one of the one or more vehicles to assume control of the at least one of the one or more vehicles to mitigate the hacking activity.

2. The computing device of claim 1, wherein the traffic pattern determination module is to determine the expected traffic behavior by (i) receiving infrastructure data from the one or more infrastructure sensors during the prior time period, (ii) receiving vehicle data from one or more vehicles located on the road segment during the prior time period, and (iii) generating the historical traffic pattern associated with the road segment for the prior time period based on an analysis of the infrastructure data and the vehicle data received during the prior time period.

3. The computing device of claim 1, wherein the network communication module is to receive external influence data from a remote source while the corresponding vehicle traverses the road segment, wherein the external influence data is indicative of factors capable of affecting the vehicle data or the infrastructure data, and wherein the traffic pattern determination module is to determine the present traffic behavior for the road segment by determining a present traffic behavior for the road segment based on the vehicle data, the infrastructure data, and the external influence data.

4. The computing device of claim 1, wherein the network communication module is to receive the vehicle data from an in-vehicle computing system of a first vehicle located on the road segment while the first vehicle traverses the road segment and from a mobile computing device located in a second vehicle located on the road segment while the second vehicle traverses the road segment.

5. The computing device of claim 1, wherein the anomaly analysis module is to identify the at least one of the one or more vehicles associated with the anomaly by tracking the anomaly across adjacent road segments of the road.

6. The computing device of claim 1, wherein the anomaly analysis module is to determine whether the anomaly is a valid anomaly by analyzing external influence data indicative of factors capable of affecting the vehicle data or the infrastructure data.

7. The computing device of claim 6, wherein the anomaly analysis module is to determine whether the anomaly is a valid anomaly by (i) generating an anomaly pattern for the anomaly, wherein the anomaly pattern is indicative of a behavior of the anomaly over a period of time, and (ii) determining whether the anomaly is a valid anomaly based on the anomaly pattern.

8. The computing device of claim 1, wherein the network communication module is to receive the infrastructure data from at least one of a traffic camera, a weather sensor, a location sensor, a weight sensor, a radar sensor, a speed sensor, a traffic signal sensor, or a lane sensor.

9. One or more computer-readable storage media comprising a plurality of instructions that, when executed, cause at least one processor to:

obtain infrastructure data from one or more infrastructure sensors associated with a road segment of a road, wherein the infrastructure data is indicative of a characteristic of the road segment;

obtain vehicle data from one or more vehicles located on the road segment, wherein the vehicle data is indicative of operational characteristics of a corresponding vehicle while the corresponding vehicle traverses the road segment;

determine a present traffic behavior for the road segment based on the vehicle data and the infrastructure data;

determine an expected traffic behavior for the road segment based on a historical traffic pattern associated with the road segment, wherein the historical traffic pattern is based on historical vehicle data and historical infrastructure data received from the one or more infrastructure sensors captured during a prior time period;

determine whether an anomaly has occurred in the present traffic behavior based on a comparison of the present traffic behavior and the expected traffic behavior;

determine whether the anomaly is a valid anomaly that corresponds to hacking activity by:

(i) calculating an anomaly probability for a plurality of anomalies that may occur in the present traffic behavior, wherein each anomaly probability is indicative of a likelihood that the corresponding anomalies would occur in the present traffic behavior, (ii) ranking the plurality of anomalies based on the anomaly probability associated with each anomaly of the plurality of anomalies, and (iii) comparing the anomaly with another detected anomaly that previously occurred on another road segment of the road, the another road segment adjacent the road segment; and enforce a response policy against the at least one of the one or more vehicles, wherein the response policy maps anomalies to corresponding response actions based on a state of the at least one of the one or more vehicles, and wherein at least one of the corresponding response actions includes communicating with the at least one of the one or more vehicles to assume control of the at least one of the one or more vehicles to mitigate the hacking activity.

10. The one or more computer-readable storage media of claim 9, wherein the plurality of instructions cause the at least one processor to determine the expected traffic behavior by:

obtaining infrastructure data from the one or more infrastructure sensors during the prior time period, obtaining vehicle data from one or more vehicles located on the road segment during the prior time period, and generating the historical traffic pattern associated with the road segment for the prior time period based on an analysis of the infrastructure data and the vehicle data obtained during the prior time period.

11. The one or more computer-readable storage media of claim 9, wherein the plurality of instructions cause the at least one processor to:

obtain external influence data from a remote source while the corresponding vehicle traverses the road segment, wherein the external influence data is indicative of factors capable of affecting the vehicle data or the infrastructure data, and wherein the instructions cause the at least one processor to determine the present traffic behavior for the road segment by determining a present traffic behavior for the road segment based on the vehicle data, the infrastructure data, and the external influence data.

12. The one or more computer-readable storage media of claim 9, wherein the plurality of instructions cause the at least one processor to obtain the vehicle data from an in-vehicle computing system of a first vehicle located on the road segment while the first vehicle traverses the road segment and from a mobile computing device located in a second vehicle located on the road segment while the second vehicle traverses the road segment.

13. The one or more computer-readable storage media of claim 9, wherein the plurality of instructions cause the at least one processor to identify the one or more vehicles associated with the anomaly by tracking the anomaly across adjacent road segments of the road.

14. The one or more computer-readable storage media of claim 9, wherein the plurality of instructions cause the at least one processor to determine whether the anomaly is a valid anomaly by analyzing external influence data indicative of factors capable of affecting the vehicle data or the infrastructure data.

15. The one or more computer-readable storage media of claim 9, wherein the plurality of instructions cause the at least one processor to:

generate an anomaly pattern indicative of a behavior of the anomaly over a period of time, and determine whether the anomaly is a valid anomaly based on the anomaly pattern.

16. A method for monitoring vehicle traffic, the method comprising:

obtaining infrastructure data from one or more infrastructure sensors associated with a road segment of a road, wherein the infrastructure data is indicative of a characteristic of the road segment;

obtaining vehicle data from one or more vehicles located on the road segment, wherein the vehicle data is indicative of operational characteristics of a corresponding vehicle while the corresponding vehicle traverses the road segment;

determining a present traffic behavior for the road segment based on the vehicle data and the infrastructure data;

determining an expected traffic behavior for the road segment based on a historical traffic pattern associated with the road segment, wherein the historical traffic pattern is based on historical vehicle data and historical infrastructure data from the one or more infrastructure sensors captured during a prior time period;

determining whether an anomaly has occurred in the present traffic behavior based on a comparison of the present traffic behavior and the expected traffic behavior;

determining whether the anomaly is a valid anomaly that corresponds to hacking activity by:

(i) calculating an anomaly probability for a plurality of anomalies that may occur in the present traffic behavior, wherein each anomaly probability is indicative of a likelihood that the corresponding anomalies would occur in the present traffic behavior, (ii) ranking the plurality of anomalies based on the anomaly probability associated with each anomaly of the plurality of anomalies, and (iii) comparing the anomaly with another detected anomaly that previously occurred on another road segment of the road, the another road segment adjacent the road segment; and enforcing, with a traffic analysis server, a response policy against the at least one of the one or more vehicles, wherein the response policy maps anomalies to corresponding response actions based on a state of the at least one of the one or more vehicles, and wherein at least one of the corresponding response actions includes communicating with the at least one of the one or more vehicles to assume control of the at least one of the one or more vehicles to mitigate the hacking activity.

17. The method of claim 16, wherein determining the expected traffic behavior includes:

obtaining infrastructure data from the one or more infrastructure sensors during the prior time period, obtaining vehicle data from one or more vehicles located on the road segment during the prior time period, and generating the historical traffic pattern associated with the road segment for the prior time period based on an analysis of the infrastructure data and the vehicle data received during the prior time period.

* * * * *